US005504561A

United States Patent [19]

Ikegawa et al.

[11] Patent Number: 5,504,561

[45] Date of Patent: Apr. 2, 1996

[54] CONTACT CHARGER AND IMAGE FORMING APPARATUS PROVIDED WITH SAME

[75] Inventors: Akihito Ikegawa, Sakai; Keiko Nagayasu, Ibaraki; Masaki Asano, Amagasaki; Masashi Yamamoto, Settsu, all of Japan

[73] Assignee: Minolta Co., Ltd., Osaka, Japan

[21] Appl. No.: 331,713

[22] Filed: Oct. 31, 1994

[30] Foreign Application Priority Data

Nov. 2, 1993 [JP] Japan ..... 5-274386

[51] Int. Cl.[6] ..... G03G 15/02

[52] U.S. Cl. ..... 355/219; 355/200

[58] Field of Search ..... 355/200, 210, 355/219, 227; 361/225

[56] References Cited

U.S. PATENT DOCUMENTS 4,387,980 6/1983 Ueno et al. ..... 355/219

5,192,974 3/1993 Ikegawa et al. ..... 355/219

5,196,892 3/1993 Mitsuaki ..... 355/219 X 5,323,215 6/1994 Ohtaka et al. ..... 355/219 X 5,353,101 10/1994 Adachi et al. ..... 355/219

*Primary Examiner*—Sandra L. Brase

*Attorney, Agent, or Firm*—Burns, Doane, Swecker & Mathis

[57] ABSTRACT

A contact charging device which charges a rotatable photoreceptor. The contact charging device has a support member provided adjacently to the photoreceptor, first and second films each one end portion of which is supported by the support member. Each free end portion of the first and second films is in contact with the surface of the photoreceptor. The second film is positioned on downstream side from the first film with respect to a rotational direction of the photoreceptor. In the above charging device, a resistance value of the first film is higher than a resistance value of the second film.

27 Claims, 3 Drawing Sheets

CONTACT CHARGER AND IMAGE FORMING APPARATUS PROVIDED WITH SAME

BACKGROUND OF THE INVENTION

1. Field of the Invention

The present invention relates to a contact charger, and more specifically relates to a contact charger and image forming apparatus provided with same for use in image forming apparatus of copying machines, facsimiles and the like.

2. Description of the Related Art

In image forming apparatus such as electrophotographic copying machine, printers, facsimiles and the like, the surface of an electrostatic latent image carrying member such as a photosensitive drum or the like is charged by means of a charging device. The charged surface of the electrostatic latent image carrying member is subjected to image light exposure to form an electrostatic latent image thereon. The thus formed electrostatic latent image is subsequently developed so as to be rendered visible, transferred onto a transfer medium, and fixed on said transfer medium.

Various types of such charging devices are known. Examples of such charging devices include corona chargers which utilize a corona discharge via a corotron system, scorotron system, serrated electrode array system or the like, and contact chargers wherein a charging member such as a brush, roller, film, belt or the like is brought into contact with the surface of the electrostatic latent image carrying member.

Chargers that utilize a corona discharge are advantageous insofar as they provide stabilized charging, however they also have certain disadvantages in that they produce large amounts of ozone, which leads to deterioration of the electrostatic latent image carrying member, and adversely affects humans. Thus, attention has become focused on contact chargers which produce markedly less ozone compared to corona chargers.

However, contact chargers using a film as a charging member are disadvantageous insofar as labor and time are necessarily involved in manufacturing a brush. Contact chargers that use a roller as a charging member have complex constructions due to the necessity of providing a mechanism to drive the roller. Since the charging roller is in direct contact with the electrostatic latent image carrying member even when the image forming apparatus is not operating, some deformation of said electrostatic latent image carrying member occurs due to the weight of said charging roller, such that said deformation causes inadequate charging of the electrostatic latent image carrying member. Contact chargers that use a plate as a charging member are susceptible to soiling of the electrostatic latent image carrying member, e.g., due to adhesion of developer and the like on the latent image carrier, and such soiling causes irregular charging of the electrostatic latent image carrying member, thereby producing nonuniform images and the like. Contact chargers that use a belt-like charging member increase the-size of the apparatus, and have the further disadvantage of having complex constructions due to the necessity of providing a mechanism to drive the belt.

U.S. patent application No. 5,192,974 discloses a contact charger of a film type for charging the surface of an electrostatic latent image carrying member via contact of said surface of an electrostatic latent image carrying member by a film supported by an end portion. However, in the aforesaid film-type contact charger, the film becomes soiled with developer and the like while image formation continues, such that streak-like charging irregularities are produced on the electrostatic latent image carrying member, which cause areas of dot-like high electric potential on the surface of the electrostatic latent image carrying member under environmental conditions of low temperature and low humidity.

SUMMARY OF THE INVENTION

A main object of the present invention is to provide a contact charger capable of stable, excellent charging over a long term.

Another object of the present invention is to provide a charging device that does not produce charging irregularities due to long-term use or environmental conditions of low temperature and low humidity.

These and other objects of the invention are achieved by providing a charging device having the following construction.

A contact charger for charging a movable charge-receiving member, said contact charger comprising:

a support member provided adjacently to said charge-receiving member;

a first film one end portion of which is supported by the support member and a free end of which is in contact with the surface of said charge-receiving member; and a second film one end portion of which is supported by the support member and a free end of which is in contact with the surface of said charge-receiving member on downstream side from said first film with respect to a moving direction of the charge-receiving member, and wherein the resistance value of the first film is higher than the resistance value of the second film.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

The preferred embodiments of the present invention are described hereinafter with reference to the accompanying drawings. The embodiments described hereinafter invariably are used in a printer, the construction of which is briefly described in FIG. 1. The printer of FIG. 1 is described below.

Figure 1:
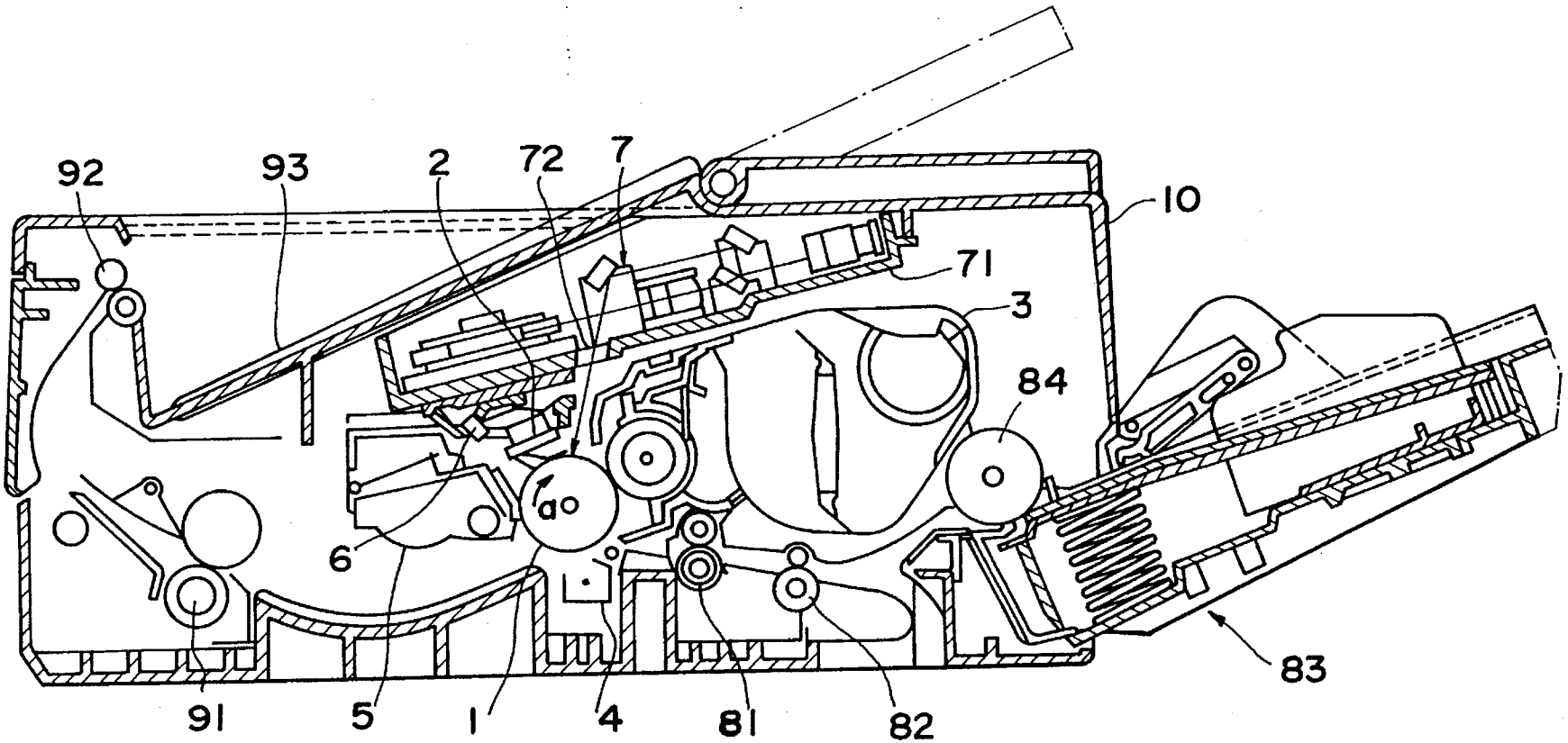
FIG. 1 briefly shows the construction of an example of an image forming apparatus using the charging device of the present invention.

The printer shown in FIG. 1 is provided with a photosensitive drum 1, i.e., electrostatic latent image carrying member, located in the central portion thereof, said drum 1 being rotatably driven in the arrow [a] direction by a drive means not shown in the drawing. Sequentially arranged around the periphery of the aforesaid drum 1 are charger 2, developing device 3, transfer charger 4, and cleaning device 5. Charger 2 is the charging device of the present invention.

Optical unit 7 is provided above photosensitive drum 1, and comprises within housing 71 a semiconductor laser generator, polygonal mirror, toroidal lens, half-mirror, spherical mirror, folding mirror, reflecting mirror and the like. An exposure slit 72 is formed in the base of said housing 71, such that exposure light is transmittable therethrough medially between the charger 2 and developing device 3 for optical exposure of the surface of photosensitive drum 1.

Sequentially arranged on the right side of photosensitive drum 1 in the drawing are a pair of timing rollers 81, pair of intermediate rollers 82, and paper cassette 83, which confronts a paper take-up roller 84. Sequentially arranged on the left side of photosensitive drum 1 in the drawing are a pair of fixing rollers 91, and pair of discharge rollers 92, which confronts discharge tray 93. The various components described above are installed in printer body 10.

In the aforesaid printer, the surface of photosensitive drum 1 is uniformly charged to a predetermined potential by charger 2, and the charged region of said surface is subjected to image exposure via optical unit 7 so as to form an electrostatic latent image thereon.

The thus formed electrostatic latent image is developed by developing device 3 so as to form a toner image, which moves to a transfer section confronting transfer charger 4.

On the other hand, a transfer paper is fed from cassette 83 by take-up roller 84, passes the pair of intermediate rollers 82, and arrives at the pair of timing rollers 81, so as to be fed to the transfer section synchronously with the toner image formed on the surface of photosensitive drum 1. At the transfer section, the toner image formed on the surface of photosensitive drum 1 is transferred onto the transfer paper via the action of transfer charger 4, said transfer paper arrives at the pair of fixing rollers 91, whereupon the toner image is fixed thereon and the transfer paper is subsequently discharged to discharge tray 93 via the pair of discharge rollers 92.

After the toner image is transferred onto the transfer paper, the residual toner remaining on the surface of photosensitive drum 1 is removed therefrom by cleaning device 5.

The basic construction of charging device 2 used in the aforesaid printer is described hereinafter with reference to FIG. 2.

In charging device 2, a plurality of flexible films are arranged along the exterior surface of photosensitive drum 1. The resistance value of the films disposed on the upstream side as viewed from the direction of rotation of photosensitive drum 1 is greater than the resistance value of films disposed on the downstream side. Therefore, uniform charging is possible even if charging irregularities result from the upstream films because the areas are again charged by the downstream films. Furthermore, uniform charging is also possible without the previously mentioned dot-like high potential areas even under environmental conditions of low temperature and low humidity.

Figure 2:
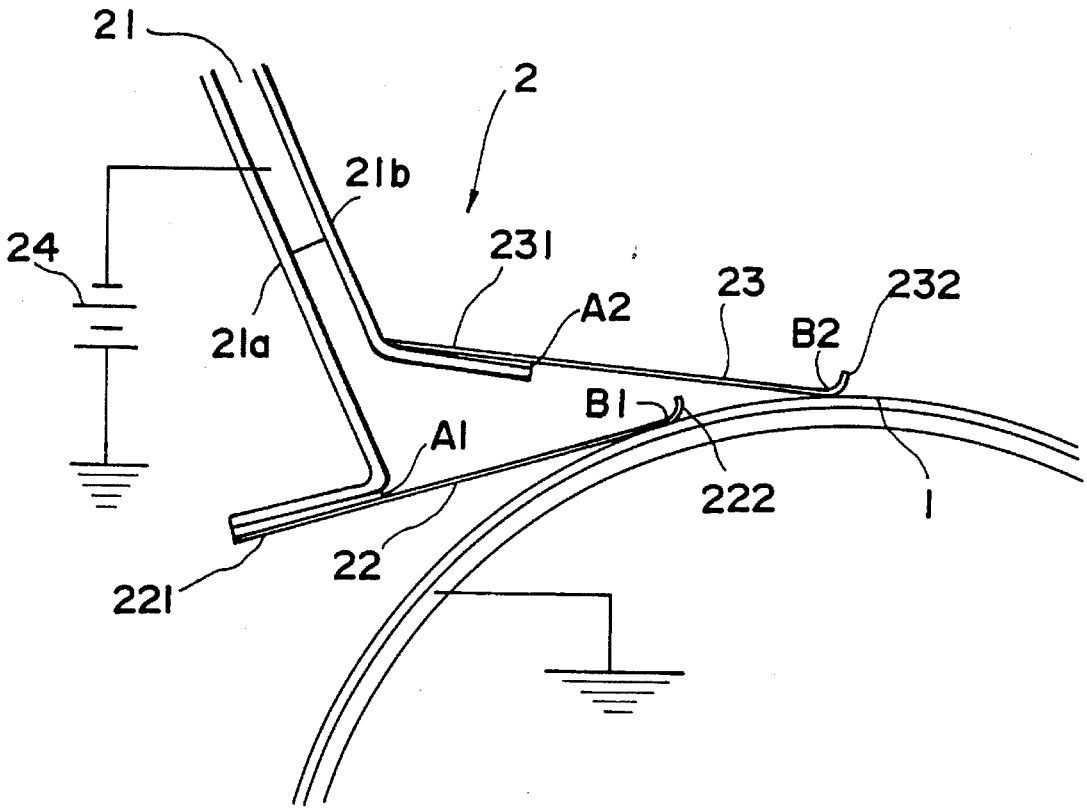
FIG. 2 is a brief section view showing an embodiment of a charging device of the present invention.

As shown in FIG. 2, conductive support member 21 is provided in charging device 2 to support the flexible film. A predetermined negative voltage is applied to the aforesaid support member 21 via power source 24. Support plates **21*a* and 21*b* (aluminum support plates in the present embodiment) are provided on support member 21. End portion 221 of flexible film 22 is attached to support plate 21*a* via a conductive adhesive at a predetermined width. End portion 231 of flexible film 23 is attached to support plate 21*b* via a conductive adhesive at a predetermined width. On the other hand, part of the free end portions 222 and 232 of film 22 and film 23 respectively make contact with the surface of photosensitive drum 1. Support plates 21*a* and 21*b*, and films 22 and 23 extend in the axial direction of photosensitive drum 1. The edges of free end portions 222 and 232 of the films form an arc-like bend having a curvature of 0.5 mm, so as to contact the surface of photosensitive drum 1 with a width of about 2 mm. Films 22 and 23 make contact with the surface of photosensitive drum 1 in the manner shown in FIG. 2 via the rotation of photosensitive drum 1**.

Resistance value $R_1$ of film 22 disposed on the upstream side in the direction of rotation of photosensitive drum 1 is greater than resistance value $R_2$ of film 23 disposed on the downstream side. The film volume resistivity is designated $\rho[\Omega\cdot cm]$, free length is designated 1 [cm], film thickness is designated t [cm], the resistance value $R_1$ $[\Omega]=\rho_1 x l_1/(t_1 x b)$ and resistance value $R_2$ $[\Omega]=\rho_2 x l_2/(t_2 x b)$ per unit width b=1 [cm]. The free length 1 is the distance from film support portion (electrode contact) to the point of contact of the film free edge with photosensitive drum 1. That is, the free length 1 is defined as the distance between $A_1$–$B_1$ and $A_2$–$B_2$, as shown in FIG. 2.

Figure 3:
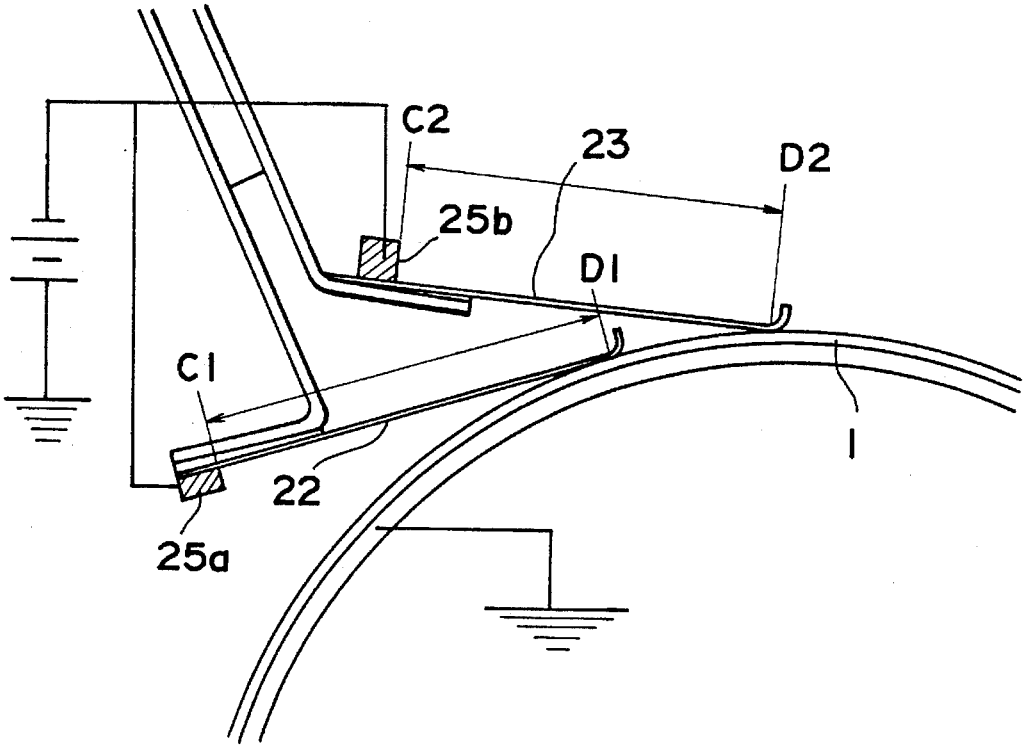
FIG. 3 is a brief section view showing a first modification of electrode construction of the charging device of FIG. 2.

FIG. 3 shows a first modification of charging device 2 of FIG. 2. Rod-like electrodes **25*a*, 25*b* are respectively provided for films 22 and 23 so as to be perpendicular relative to the direction of rotation of photosensitive drum 1, but otherwise the construction of the first modification is identical to that of charging device 2 of FIG. 2; therefore, further description is omitted. In the device of FIG. 3, the free length 1 of films 22 and 23** is defined as the distances between points $C_1$–$D_1$ and $C_2$–$D_2$, respectively.

Figure 4:
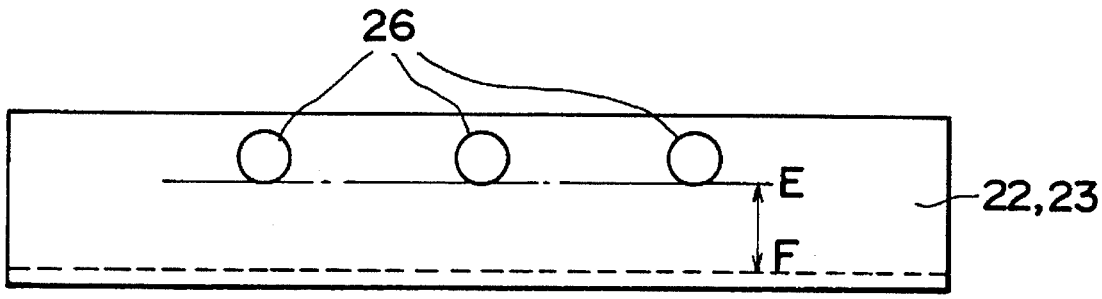
FIG. 4 is an illustration showing a second modification of electrode construction of the charging device of FIG. 2.
Figure 5:
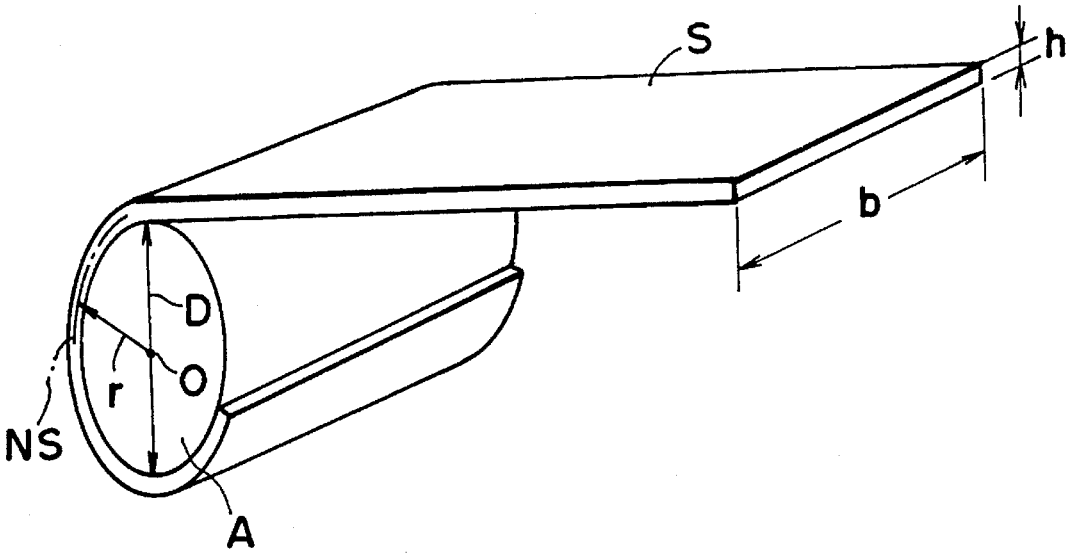
FIG. 5 is an illustration showing an embodiment of a flexible charging film of the present invention.

FIG. 4 shows a second modification of charging device 2 of FIG. 2. A plurality of electrodes 26 are provided respectively for films 22 and 23, but otherwise the construction of the second modification is identical to that of charging device 2 of FIG. 2; therefore, further description is omitted. In the device of FIG. 4, the free length 1 of films 22 and 23 is defined as the distance between points E–F. FIG. 4 is an elevation perspective viewed from above films 22 and 23. In the drawing, reference symbol F refers to the contact position of the film free edge and surface of photosensitive drum 1.

When resistance value $R_1$ of film 22 disposed on the upstream side in the direction of rotation of photosensitive drum 1 is less than resistance value $R_2$ of film 23 disposed on the downstream side, generation of image irregularities during image formation cannot be sufficiently prevented.

The relationship between resistance value R1 of the film on the upstream side and resistance value R2 of the film on the downstream side preferably is expressed as:

$$3\times10^8\Omega<R_1-R_2<1.5\times10^9\ \Omega$$

It is desirable that the flexible film of the present invention have a bending moment M necessary to wind thin material S having a width b=1 cm on a core A having a circular cross section of external diameter D=1 cm which is $M\leqq20$ [g·cm], and preferably $M\leqq10$ [g·cm].

Bending moment M is a numerical value determined by the equation $M=EI/r$, where $I=bh^3$. The value E is Young's modulus [g/cm$^2$], value I is the film's geometrical moment of inertia [cm$^4$], and value r is the film's radius of curvature [cm]. The distance h between the center of curvature, i.e., center 0 of core A, and the film's neutral surface NS is the thickness [cm] of the film.

Films incorporating conductive material such as metal powder, carbon powder or the like within a synthetic resin material are useable as the aforesaid flexible film.

Examples of useable metal powders include metals such as aluminum, gold, copper, iron, silver, chromium, nickel, platinum, zinc, titanium and the like, or alloys thereof.

Examples of useful synthetic resins include polyolefin resins such as polyethylene, polypropylene and the like, polyacetal resins such as polyvinyl alcohol, polyvinyl acetate and the like, acrylic resins such as ethylene-vinyl acetate copolymer, polymethyl methacrylate, acrylonitrile-methylacrylate copolymer and the like, cellulose resins such as polycarbonate, polystyrene, acrylionitrile-butadiene-styrene copolymer, polyethylene terephthalate, polyurethane elastomer, viscose rayon, cellulose nitrate, cellulose acetate, cellulose triacetate, cellulose propionate, cellulose acetate butyrate, ethyl cellulose, regenerated cellulose, polyamide resins such as nylon 6, nylon 66, nylon 11, nylon 12, nylon 46 and the like, halogenated polyvinyl resins such as polyimide, polysulfon, polyether sulfon, polyvinyl chloride, vinyl chloride-vinyl acetate copolymer, polyvinylidene chloride, vinylidene chloride-vinyl chloride copolymer, polytetrafluoroethylene, polychlorofluoroethylene, polyvinyl fluoride, polyvinylidene fluoride and the like, and vinylnitrile rubber alloy.

The present invention is not limited to the use of the two charging films of the previously described embodiments, inasmuch as, for example, three or more films may be used. For example, three films A, B and C respectively having resistance values $R_1$, $R_2$ and $R_3$ are provided along the exterior surface of the photosensitive drum 1. Film A is positioned on the upstream side from the film B, and the film B is positioned on the upstream side from the film C as viewed from the rotational direction of the photosensitive drum 1. In each of the following relationships between the resistance values, uniform charging is possible.

$R_1>R_2$ $R_2>R_3$ $R_1>R_3$

Furthermore, although two charging films made of the same materials are used in the previously described embodiments, it is to be understood that films made of different materials may be used.

Specific examples using the previously described charging device 2 of the present invention are described hereinafter.

In the printer shown in FIG. 1, the processing speed (peripheral speed of photosensitive drum 1) was set at 3.5 cm/sec. developing device 3 is a monocomponent, contact type developing device for accomplishing reversal development. Photosensitive drum 1 is a negative charge, organic photosensitive member of a function-separated type having a sensitivity relative to long-wavelength light. Specifically, photosensitive drum 1 was an organic photosensitive member of a function-separated type. The photosensitive drum 1 has an aluminum drum over which is sequentially superimposed a charge-generating layer comprising a mixture of r-type metallic phthalocyanine and polyvinylbutyral resin having a thickness of about 0.4 μm, and a charge-transporting layer comprising a mixture of mainly hydrazonated compound and polycarbonate resin having a thickness of about 18 μm. A negative-charge toner having a mean particle diameter of 10 μm obtained by kneading, pulverizing and classifying a mixture whose main constituents were bisphenol A polyester resin and carbon black was used as the toner in developing device 3. This toner was accommodated in the previously described developing device 3, and used for developing with a developing bias of −300 V.

Charging films 22 and 23 films having carbon black dispersed in polyimide resin. The free end portion had a fold of R 0.5 mm, and a voltage of −1.35 kV was applied to each film via power source 24. At this time, the results of image evaluation are shown in Table 1 when film volume resistivity ρ, free length 1, and thickness t were varied.

Measurement of photosensitive drum surface potential and potential irregularities were accomplished setting the probe of a surface potentiometer (Torekku, model 360) at the developing position, and measuring the surface potential $V_0$ of photosensitive drum 1, and oscillation width of said surface potential $\Delta V_0$.

Image noise evaluation was accomplished using a Sakura Densitometer (model PDA-65, Konica K.K.). A 1-dot by 4-dot dot image was printed, and the variation of range in image density was measured in the width direction after 500 prints.

Image density variation of less than 0.05 produced excellent images without image noise and were rated ⊙. Image density variation of 0.05~0.1 produced images without discernable image noise and were rated ○. Image density variation of 0.1~0.15 produced images usable from a practical perspective but which had some discernable image noise and were ranked Δ. Image density variation greater than 0.15 produced images which were unusable from a practical perspective with definite image noise and were ranked X.

TABLE 1

| | Film 22 | | | | Film 23 | | | | | |
|---|---|---|---|---|---|---|---|---|---|---|
| | Volume resistivity p [Ω · cm] | Free length l [cm] | Film thickness t [μm] | Resistance R1 [Ω] × $10^8$ | Volume resistivity p [Ω · cm] | Free length l [cm] | Film thickness t [μm] | Resistance R2 [Ω] × $10^8$ | R1 − R2 [Ω] × $10^8$ | Image Evaluation |
| Ex. 1 | $3.0 \times 10^6$ | 1.0 | 30 | 1000 | $0.1 \times 10^6$ | 1.0 | 25 | 40 | 960 | ⊙ |
| Ex. 2 | $0.5 \times 10^6$ | 1.5 | 20 | 375 | $0.02 \times 10^6$ | 1.0 | 35 | 5 | 370 | ⊙ |
| Ex. 3 | $4.0 \times 10^6$ | 1.0 | 25 | 1600 | $1.0 \times 10^6$ | 1.0 | 30 | 333 | 1267 | ⊙ |
| Ex. 4 | $3.0 \times 10^6$ | 1.0 | 20 | 1500 | $0.1 \times 10^6$ | 1.0 | 30 | 33 | 1467 | ⊙ |
| Ex. 5 | $5.0 \times 10^6$ | 1.0 | 25 | 2000 | $1.0 \times 10^6$ | 1.0 | 30 | 333 | 1667 | ○ |
| Ex. 6 | $0.5 \times 10^6$ | 2.0 | 20 | 500 | $0.5 \times 10^6$ | 1.0 | 20 | 250 | 250 | ○ |
| Ex. 7 | $0.3 \times 10^6$ | 1.0 | 20 | 150 | $0.2 \times 10^6$ | 1.0 | 15 | 133 | 17 | Δ |

TABLE 1-continued

| | Film 22 | | | | Film 23 | | | | | |
|---|---|---|---|---|---|---|---|---|---|---|
| | Volume resistivity p [Ω · cm] | Free length l [cm] | Film thickness t [μm] | Resistance R1 [Ω] × $10^8$ | Volume resistivity p [Ω · cm] | Free length l [cm] | Film thickness t [μm] | Resistance R2 [Ω] × $10^8$ | R1 − R2 [Ω] × $10^8$ | Image Evaluation |
| Ex. 8 | 1.0 × $10^6$ | 1.0 | 30 | 333 | 4.0 × $10^6$ | 1.0 | 25 | 1600 | −1267 | X |

It can be understood from the results shown in Table 1 that when the volume resistivity of the film is designated ρ, free length is designated 1, and layer thickness is designated t, and the upstream side film resistance value $R_1$ at unit width b is such that $R_1=\rho_1 x l_1/(t_1 x b)$ and is greater than the downstream side film resistance value $R_2$ which is such that $R_2=\rho_2 x l_2/(t_2 x b)$, stable images were obtained with little or no image irregularities resulting from charge irregularities. Furthermore, when the difference between the upstream side film resistance value and the downstream side film resistance value was within the range $3\times10^8\ \Omega<R_1-R_2<1.5\times10^9\ \Omega$, superior stable images were obtained which with even less image irregularities.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A contact charging device for charging a movable charge-receiving member, said contact charging device comprising:

a support member provided adjacently to said charge-receiving member;

a first film one end portion of which is supported by said support member, and a free end portion of which is in contact with the surface of said charge-receiving member; and a second film one end portion of which is supported by the support member and a free end portion of which is in contact with the surface of said charge-receiving member on downstream side from the first film with respect to a moving direction of the charge-receiving member, and wherein a resistance value of the first film is higher than a resistance value of the second film.

2. A contact charging device as claimed in claim 1 wherein resistance value $R_1$ of the first film per unit width b=1 [cm] and resistance value $R_2$ of the second film per unit width b=1 [cm] are respectively defined by the following equations:

$R_1$ [Ω]$=\rho_1 x l_1/(t_1 x b)$ $R_2$[Ω]$=\rho_2 x l_2/(t_2 x b)$

ρ: volume resistivity [Ω·cm]

l: free length [cm]

t: thickness [cm]

3. A contact charging device as claimed in claim 2 wherein the relationship between the resistance value $R_1$ of the first film and the resistance value $R_2$ of the second film is expressed as:

$$3\times10^8\ \Omega<R_1-R_2<1.5\times10^9\ \Omega$$

4. A contact charging device as claimed in claim 1 wherein the support member is conductive,

5. A contact charging device as claimed in claim 4 wherein the support member includes a first portion for supporting the first film and a second portion for supporting the second film.

6. A contact charging device as claimed in claim 5 wherein the first and second films are adhered respectively to the first and second portions of the support member by conductive adhesive.

7. A contact charging device as claimed in claim 6 wherein a voltage is applied to the support member.

8. A contact charging device as claimed in claim 6 wherein each of the first and second films is provided with a rod-shape electrode at an adhesion portion of the film and the support portion, and each of the electrodes is provided along the adhesive portion in a direction perpendicular to a moving direction of the charge-receiving member.

9. A contact charging device as claimed in claim 6 wherein each of the first and second films is provided with a plurality of electrodes at an adhesion portion of the film and support portion, and the plurality of the electrodes are provided along the adhesion portion in a direction perpendicular to a moving direction of the charge-receiving member.

10. A contact charging device as claimed in claim 1 wherein a bending moment M is set at not more than 20 g·cm.

11. A contact charging device as claimed in claim 1 wherein the first and second films are formed of a synthetic resin in which conductive material is incorporated.

12. An image forming apparatus comprising:

a rotatable photoreceptor;

a support member provided along an exterior surface of said photoreceptor;

a first film one end portion of which is supported by said support member and a free end portion of which is in contact with the surface of the photoreceptor; and a second film one end portion of which is supported by said support member and a free end portion of which is in contact with the surface of the photoreceptor on downstream side from the first film with respect to a rotational direction of the photoreceptor, and wherein the resistance value of the first film is higher than the resistance value of the second film.

13. An image forming apparatus as claimed in claim 12 wherein resistance value $R_1$ of the first film per unit width b=1 [cm] and resistance value $R_2$ of the second film per unit width b=1 [cm] are respectively defined by the following equations:

$R_1$ [Ω]$=\rho_1 x l_1/(t_1 x b)$ $R_2$ [Ω]$=\rho_2 x l_2/(t_2 x b)$

ρ: volume resistivity [Ω·cm]

l: free length [cm]

t: thickness [cm]

14. An image forming apparatus as claimed in claim 12 wherein the support member is conductive.

15. An image forming apparatus as claimed in claim 14 wherein the support member includes a first support portion for supporting the first film and a second support portion for supporting the second film.

16. An image forming apparatus as claimed in claim 15 wherein the first and second films are respectively adhered to the first and second support portions of the support member by conductive adhesive.

17. An image forming apparatus as claimed in claim 16 wherein a voltage is applied to the support member.

18. An image forming apparatus as claimed in claim 16 wherein each of the first and second films is provided with a rod-shape electrode at an adhesion portion of the film and the support portion, and each of the electrodes is provided along the adhesive portion in a direction perpendicular to a rotational direction of the photoreceptor.

19. An image forming apparatus as claimed in claim 16 wherein each of the first and second films is provided with a plurality of electrodes at an adhesion portion of the film and support portion, and the plurality of the electrodes are provided along the adhesion portion in a direction perpendicular to a rotational direction of the photoreceptor.

20. An image forming apparatus as claimed in claim 12 wherein a bending moment M is set at not more than 20 g·cm.

21. An image forming apparatus as claimed in claim 12 wherein the first and second films are formed of a synthetic resin in which conductive material is incorporated.

22. An image forming apparatus as claimed in claim 12 wherein the relationship between the resistance value $R_1$ of the first film and the resistance value $R_2$ of the second film is expressed as:

$$3\times10^8\ \Omega<R_1-R_2<1.5\times10^9\ \Omega$$

23. A contact charging device for charging a movable charge-receiving member, said contact charging device comprising:

a support member provided adjacently to said charge-receiving member;

a first film one end portion of which is supported by said support member, and a free end portion of which is in contact with the surface of said charge-receiving member; and a second film one end portion of which is supported by said second support member and a free end portion of which is in contact with the surface of said charge-receiving member on downstream side from the first film with respect to a moving direction of the charge-receiving member, and wherein a volume resistivity of the first film is higher than a volume resistivity of the second film.

24. A contact charging device as claimed in claim 23 wherein the support member is conductive.

25. A contact charging device as claimed in claim 23 wherein the support member includes a first support portion for supporting the first film and a second support portion for supporting the second film.

26. A charging device as claimed in claim 25 wherein the first and second films are respectively adhered to the first and second support portions of the support member by conductive adhesive.

27. A charging device as claimed in claim 26 wherein a voltage is applied to the support member.

* * * * *